US005781931A

United States Patent [19]

Lee

[11] Patent Number: 5,781,931

[45] Date of Patent: Jul. 21, 1998

[54] METHOD FOR MAKING ERGONOMIC GLOVES

[76] Inventor: Arnold Yoonho Lee, 4491 Deanwood Dr., Woodland Hills, Calif. 91364

[21] Appl. No.: 963,026

[22] Filed: Nov. 3, 1997

[51] Int. Cl.[6] ..... A41D 19/00

[52] U.S. Cl. ..... 2/169; 2/163

[58] Field of Search ..... 2/159, 161.1, 161.6, 2/163, 165, 166, 169, 2

[56] References Cited

U.S. PATENT DOCUMENTS

| | | | |
|---|---|---|---|
| 628,017 | 7/1899 | Murphy | 2/163 |
| 2,056,555 | 10/1936 | Auster et al. | 2/163 |
| 4,494,249 | 1/1985 | Hansson | 2/169 |
| 4,654,896 | 4/1987 | Rinehart | 2/169 |
| 4,907,297 | 3/1990 | Gallucci | 2/163 |
| 4,908,991 | 3/1990 | Field | 2/163 |
| 5,566,405 | 10/1996 | Masley | 2/169 |
| 5,682,614 | 11/1997 | Lazarus | 2/169 |

*Primary Examiner*—Amy B. Vanatta
*Attorney, Agent, or Firm*—Eugene Oak

[57] ABSTRACT

A method for converting a conventional glove into a more comfortable glove by altering the shape of the glove fingers of the conventional glove. A stitching is usually disposed along the tips of the glove fingers of a conventional glove which causes discomfort because it is not aligned with the fingernails of the hand in the glove. An aperture is cut into the upper portion of the glove finger and the aperture is sewn together, thereby pulling the stitching upward to be aligned with the fingernail and creating a more comfortable glove. Alternatively, a fold is made on the upper portion of the glove finger and the fold is sewn together, thereby pulling the stitching upward to be aligned with the fingernail and creating a more comfortable glove.

20 Claims, 2 Drawing Sheets

METHOD FOR MAKING ERGONOMIC GLOVES

BACKGROUND OF THE INVENTION

1. Field of the Invention

The present invention relates generally to gloves, and specifically gloves which are made in order to accommodate the natural contours of a human hand.

2. Description of the Prior Art

The prior art in the field of gloves teach different variations of gloves, including gloves with traction in order to facilitate gripping, gloves with additional material to provide additional protection, gloves with apertures to permit air to circulate within the gloves, gloves used in sports such as golf or baseball, and gloves with different fastening mechanisms which ensure the adherence of the glove to the hand. In addition, several different ornamental designs have been proposed, as gloves are useful accessories in the art of fashion. The present invention, however, teaches a glove which is markedly from all of the aforementioned gloves. Moreover, the present invention may be applied to any or all of the aforementioned gloves.

The stitching in gloves often do not amply accommodate the human hand. In particular, in examining one's thumb, it is apparent that while the top of the thumb, that is, the thumb nail side, is considerably flat and curves slightly upward, the bottom of the thumb, that is, the portion on which a thumb print may be ascertained, is not flat but curves upward to meet the thumb nail. Despite this, gloves manufactured today are consistently made in a manner that accommodates a perfectly symmetric hand, with no subtle differences between the top and the bottom of the thumb. This results in the stitching of the glove at the tip of the thumb to not lie along the tip of the nail, which is the appropriate location for the stitching, but somewhere along the bottom of the thumb, thereby causing discomfort.

In the sport of golf, it is of utmost importance to have sure handling of the various golf clubs that are commonly used. To ensure a proper grip of the golf clubs and to protect the golfers' hands, golfers often wear gloves. Because of the deficiencies existing in conventional gloves which have already been explained, golf gloves which are currently available often add some discomfort to the golfer during his stroke, thereby contributing to a poorer performance. This problem is not just present in the sport of golf, but in any sport which employs the use of gloves, such as baseball, hockey, and football. The present invention overcomes this problem by providing an ergonomic glove.

Accordingly, the primary object of the present invention is to provide a glove which alleviates the discomfort which arises from the stitching of conventional gloves.

Another object of the present invention is to provide a method for improving a conventional glove in order to better accommodate the thumb of a human hand.

Yet another object of the present invention is to provide a method for improving a conventional glove which is a relatively inexpensive method.

SUMMARY OF THE INVENTION

The present invention comprises a method for altering an existing glove in order to make a glove which better accommodates the thumb of a human hand. Three separate embodiments are taught which involve the cutting and sewing of a conventional glove in order to make the upper portion of the thumb sheath of the glove relatively flat while making the lower portion of the thumb sheath of the glove curve upwards to meet the upper portion at a position proximal to the tip of the thumb nail.

These together with other objects of the invention are explained clearly in the claims annexed to and forming a part of this disclosure. For a better understanding of the invention, its operating advantages and the specific objects attained by its use, reference should be made to the accompanying drawings and descriptive matter in which there are illustrated preferred embodiments of the invention.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
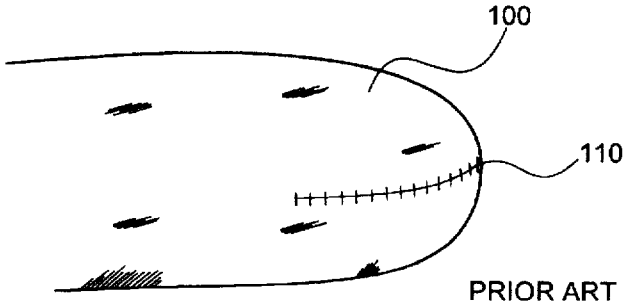
FIG. 1 is a side view of the compartment of a conventional glove which accommodates the thumb.

Referring to FIG. 1, the thumb compartment 100 of a conventional glove is depicted. Normally, a stitching 110 is centrally disposed along the tip of the thumb compartment. Because this stitching 110 is not aligned with the tip of a human thumb, it causes discomfort and an improper fit of the glove.

Figure 2:
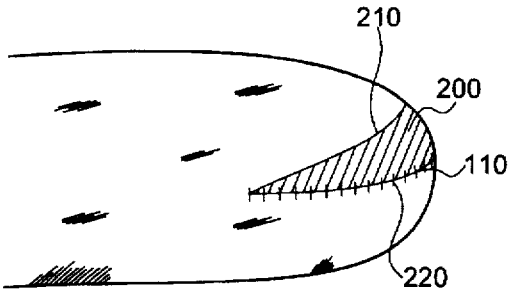
FIG. 2 is a side view of the first embodiment of the present invention which depicts the portion of the conventional glove which is to be removed for this particular embodiment.
Figure 3:
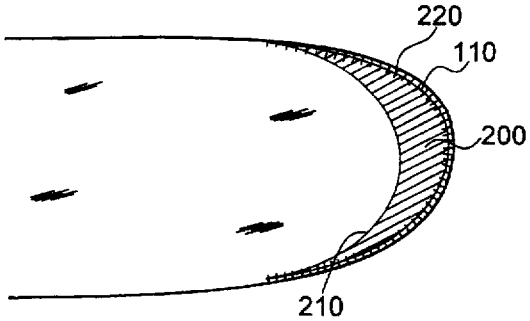
FIG. 3 is a top view of the first embodiment of the present invention which depicts the portion of the conventional glove which is to be removed for this particular embodiment.
Figure 4:
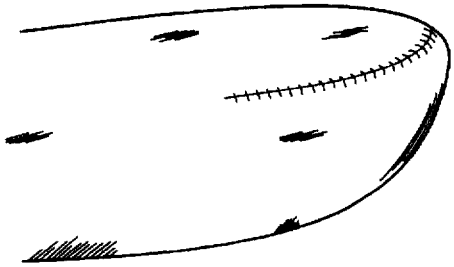
FIG. 4 is a side view of the first embodiment of the present invention.
Figure 5:
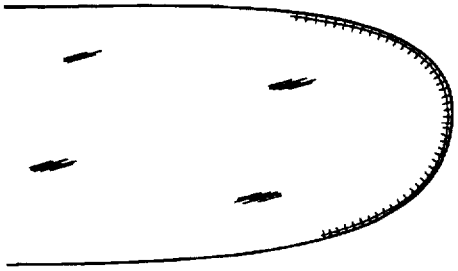
FIG. 5 is a top view of the first embodiment of the present invention.

FIG. 2 and FIG. 3 depict the manner in which the first embodiment of the present invention provides a more ergonomic thumb compartment. The shaded region located above the stitching 110 indicates the portion of the thumb compartment which is to be removed and which thereby creates a crescent-shaped aperture 200. The sides of this aperture 210 and 220 are then stitched together, which consequently pulls the stitching 110 upward to be aligned with the tip of a human thumb. The resulting thumb compartment is depicted in FIG. 4 and FIG. 5. It is apparent from these figures that after undergoing the aforementioned modification, the thumb compartment resembles a human thumb, which is an indication that the first embodiment fits a human thumb more appropriately than an unmodified thumb compartment of a conventional glove.

Figure 6:
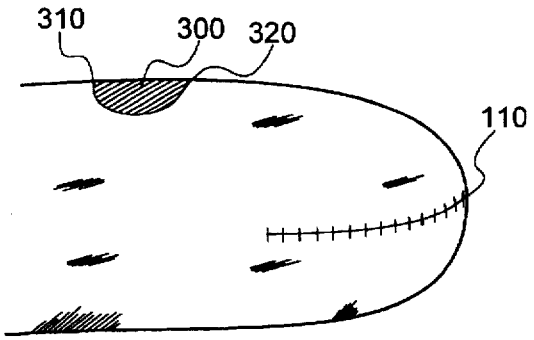
FIG. 6 is a side view of the second embodiment of the present invention which depicts the portion of the conventional glove which is to be removed for this particular embodiment.
Figure 7:
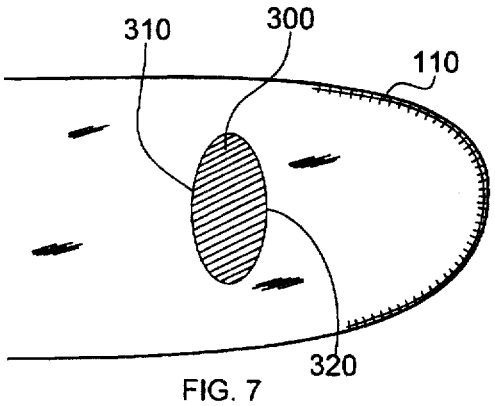
FIG. 7 is a top view of the second embodiment of the present invention which depicts the portion of the conventional glove which is to be removed for this particular embodiment.
Figure 8:
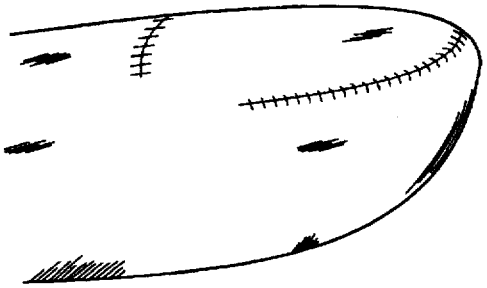
FIG. 8 is a side view of the second embodiment of the present invention.
Figure 9:
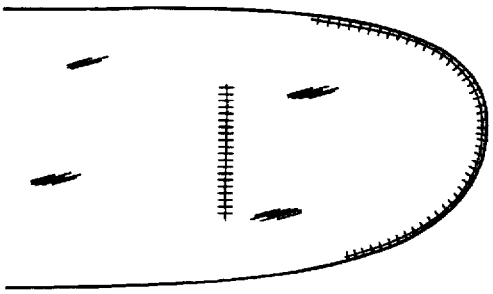
FIG. 9 is a top view of the second embodiment of the present invention.

FIG. 6 and FIG. 7 depict the manner in which the second embodiment of the present invention provides a more ergonomic thumb compartment. The shaded region disposed on the upper portion of the thumb compartment indicates the portion of the thumb compartment which is to be removed and which thereby creates an oval-shaped aperture 300. The sides of this aperture 310 and 320 are then stitched together, which consequently pulls the stitching 110 upward to be aligned with the tip of a human thumb. The resulting thumb compartment is depicted in FIG. 8 and FIG. 9. It is apparent from these figures that after undergoing the aforementioned modification, the thumb compartment resembles a human thumb, which is an indication that the second embodiment fits a human thumb more appropriately than an unmodified thumb compartment of a conventional glove.

Figure 10:
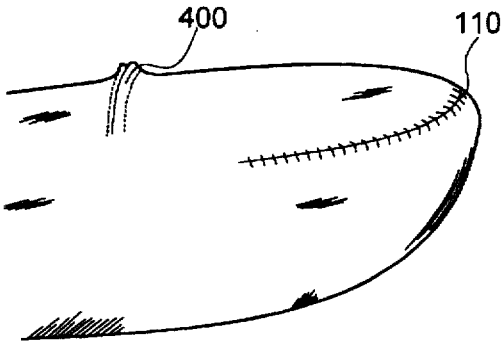
FIG. 10 is a side view of the third embodiment of the present invention.
Figure 11:
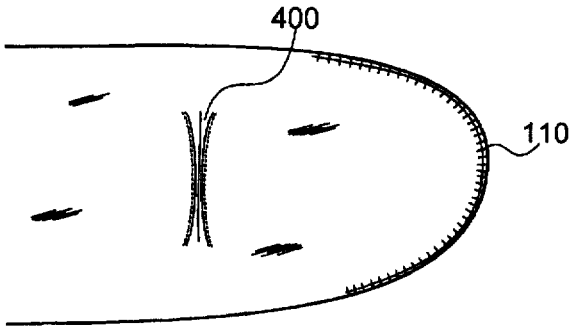
FIG. 11 is a top view of the third embodiment of the present invention.

FIG. 10 and FIG. 11 depict the manner in which the third embodiment of the present invention provides a more ergonomic thumb compartment. In this embodiment, instead of the removal of a part of the thumb compartment and the subsequent stitching of the resulting aperture, a latitudinal fold 400 is made traversing the length of the thumb compartment, wherein this fold 400 is stitched together which consequently pulls the stitching 110 upward to be aligned with the tip of a human thumb. It is apparent from these figures that after undergoing the aforementioned modification, the thumb compartment resembles a human thumb, which is an indication that the third embodiment fits a human thumb more appropriately than an unmodified thumb compartment of a conventional glove.

What is claimed as being new and therefore desired to be protected by letters patent of the United States is as follows:

1. A method for converting a conventional glove into an ergonomic glove comprising forming an aperture into a glove finger of said conventional glove, said aperture positioned above a centrally disposed stitching located along the tip of said glove finger, wherein said aperture is closed, thereby displacing said stitching of said glove finger and positioning said stitching to be aligned with the fingernail of a finger accommodated by said glove finger.

2. A method for converting a conventional glove into an ergonomic glove as mentioned in claim 1, wherein said glove finger is intended to accommodate a thumb.

3. A method for converting a conventional glove into an ergonomic glove as mentioned in claim 1, wherein said glove finger is intended to accommodate an index finger.

4. A method for converting a conventional glove into an ergonomic glove as mentioned in claim 1, wherein said glove finger is intended to accommodate a middle finger.

5. A method for converting a conventional glove into an ergonomic glove as mentioned in claim 1, wherein said glove finger is intended to accommodate a third finger.

6. A method for converting a conventional glove into an ergonomic glove as mentioned in claim 1, wherein said glove finger is intended to accommodate a little finger.

7. A method for converting a conventional glove into an ergonomic glove as mentioned in claim 1, wherein said aperture is crescent-shaped.

8. A method for converting a conventional glove into an ergonomic glove as mentioned in claim 1, wherein said aperture is oval-shaped.

9. A method for converting a conventional glove into an ergonomic glove as mentioned in claim 1, wherein said aperture is closed by traversed stitching with respect to said glove finger.

10. A method for converting a conventional glove into an ergonomic glove as mentioned in claim 1, wherein said aperture is closed by an adhesive.

11. A method for converting a conventional glove into an ergonomic glove as mentioned in claim 1, wherein said aperture is positioned above a centrally disposed means of fastening located along the tip of said glove finger, said means of fastening displaced and positioned to be aligned with the fingernail of a finger accommodated by said glove finger.

12. A method for converting a conventional glove into an ergonomic glove comprising folding a portion of a glove finger of said conventional glove, thereby creating a fold, said fold located on upper side of said glove finger, wherein said fold is clamped together, thereby displacing said stitching of said glove finger and pulling a centrally disposed stitching located along the tip of said glove finger upward to be aligned with the fingernail of a finger accommodated by said glove finger.

13. A method for converting a conventional glove into an ergonomic glove as mentioned in claim 12, wherein said glove finger is intended to accommodate a thumb.

14. A method for converting a conventional glove into an ergonomic glove as mentioned in claim 12, wherein said glove finger is intended to accommodate an index finger.

15. A method for converting a conventional glove into an ergonomic glove as mentioned in claim 12, wherein said glove finger is intended to accommodate a middle finger.

16. A method for converting a conventional glove into an ergonomic glove as mentioned in claim 12, wherein said glove finger is intended to accommodate a third finger.

17. A method for converting a conventional glove into an ergonomic glove as mentioned in claim 12, wherein said glove finger is intended to accommodate a little finger.

18. A method for converting a conventional glove into an ergonomic glove as mentioned in claim 12, wherein said fold is clamped together by means of traversed stitching with respect to said glove finger.

19. A method for converting a conventional glove into an ergonomic glove as mentioned in claim 12, wherein said fold is clamped together by means of an adhesive.

20. A method for converting a conventional glove into an ergonomic glove as mentioned in claim 12, wherein said fold is positioned above a centrally disposed means of fastening located along the tip of said glove finger, said means of fastening displaced and positioned to be aligned with the fingernail of a finger accommodated by said glove finger.

* * * * *